United States Patent [19]

Hennessy

[11] Patent Number: 5,016,455

[45] Date of Patent: May 21, 1991

[54] KEY UNLOCKING AND RETAINING METHOD AND APPARATUS

[75] Inventor: Thomas F. Hennessy, Bristol, Conn.

[73] Assignee: Lori Corporation, Southington, Conn.

[21] Appl. No.: 535,334

[22] Filed: Jun. 8, 1990

[51] Int. Cl.[5] ..... E05B 27/00

[52] U.S. Cl. ..... 70/493; 70/389; 70/419; 70/421; 70/405

[58] Field of Search ..... 70/493, 358, 416, 419, 70/421, 402, 405–407, 409, 411, 389, 390

[56] References Cited

U.S. PATENT DOCUMENTS

| | | | |
|---|---|---|---|
| 758,025 | 4/1904 | Taylor | 70/421 X |
| 1,958,603 | 5/1934 | Bacon | 70/493 X |
| 1,977,189 | 10/1934 | Larson et al. | 70/419 X |
| 2,247,621 | 7/1941 | Speer | 70/493 |
| 2,469,018 | 5/1949 | Swanson | 70/389 |
| 3,702,550 | 11/1972 | Shimizu | 70/389 X |
| 4,028,917 | 6/1977 | Schlage | 70/389 |
| 4,120,184 | 10/1978 | Gerlach | 70/389 |
| 4,376,381 | 3/1983 | Muus | 70/389 X |
| 4,823,575 | 4/1989 | Florian et al. | 70/419 X |

*Primary Examiner*—Gary L. Smith
*Assistant Examiner*—Suzanne L. Dino
*Attorney, Agent, or Firm*—Chilton, Alix & Van Kirk

[57] ABSTRACT

A cylinder lock system employing a key having a projection extending from each opposing parallel edge of the key blade, the projections respectively operating an auxiliary pin tumbler stack and cooperating with a groove in the lock shell to retain the key in the lock after plug rotation from the key insertion position. The key retaining projection also cooperates with the driver pin of the auxiliary pin tumbler stack to prevent key trapping, i.e., the presence and size of the retaining projections keeps the auxiliary driver pin from engaging the keyway. The cooperation between the key retaining projection and the auxiliary driver pin is permitted by providing the lock with two shear lines, located on different diameters, which are simultaneously operable by a single key.

7 Claims, 2 Drawing Sheets

KEY UNLOCKING AND RETAINING METHOD AND APPARATUS

BACKGROUND OF THE INVENTION (1) Field of the Invention

The present invention relates generally to pin tumbler-type cylinder locks and associated keys. More particularly, this invention is directed to enhancing the security afforded by cylinder locks and especially to enhancing the ability of such locks to resist operation by a key obtained from an unauthorized source. Accordingly, the general objects of the present invention are to provide novel and improved apparatus and methods of such character.

(2) Description of the Prior Art

U.S. Pat. No. 4,823,575 discloses a novel cylinder lock and an associated key. The patented key, in addition to conventional bitting, is provided with a pair of projections on the opposite edges of the blade. These projections perform the dual function of operating an auxiliary pin tumbler stack, to permit rotation of the key and plug relative to the shell, and retaining the key in the keyway. The unique manner of implementation of the key retention function also reduces key and lock wear when force is imparted to the inserted key to move the door in which the lock is installed. U.S. Pat. No. 4,823,575 depicts a key wherein the bitting is in the form of depressions formed in the key blade, i.e., the patent depicts a "Kaba" type key. It will be understood by those skilled in the art, however, that the patented invention is equally applicable to a key wherein the bitting is, again by way of example only, in the form of conventional serrations in one or both edges of the key blade. Additionally, the patent depicts a reversible key, i.e., a key wherein the bitting is symmetrical and the two projections are of substantially the same size and shape. It will also be obvious to those skilled in the art that the patented invention is applicable to a key and lock combination where the pin tumbler arrangement is not symmetrical and where the projections serve separate and discrete functions, i.e., one projection operates the auxiliary pin tumbler stack while the other projection is intended for key retention only.

The lock and key of U.S. Pat. No. 4,823,575 have enjoyed significant commercial success. The patented combination, however, lacks a capability which many purchasers of high security locks desire. This capability is known in the art as "trapping". With trapping capability, should an attempt be made to operate a lock with an unauthorized key, such key is captured in the lock if the attempt to rotate the plug relative to the shell proves successful. A "trapped" key may not be withdrawn from the keyway without disassembly of the lock and trapping will prevent further plug rotation.

SUMMARY OF THE INVENTION

The present invention comprises an improvement to the lock and associated key of U.S. Pat. No. 4,823,575 and particularly adds a trapping function to the patented combination. A cylinder lock in accordance with the present invention is characterized by two separate parting lines, and particularly two shear lines located at different radial distances from the axis of the shell. The primary pin tumbler stacks are associated with a first of these parting lines while an auxiliary pin tumbler stack is associated with the second parting line. The second parting line, in a preferred embodiment, is located at a greater radial distance from the cylinder lock axis than the first parting line.

The shell of the lock has portions of at least two different diameters, commensurate with the two parting lines, and the plug has a shape which is, in two portions, complementary in shape to the shell. A circumferential retaining groove is formed in that portion of the shell which is associated with the auxiliary pin tumbler stack. A longitudinal slot or recess having the same depth as the groove communicates between the forward end of the shell and the groove.

A key in accordance with the invention has, in addition to conventional bitting for operating the primary pin tumbler stacks, a pair of projections extending from the opposed edges of the key blade. These projections are, at least in part, in alignment. A first projection causes translation of the auxiliary pin tumbler stack to permit rotation of the plug relative to the shell. The second projection is longer than the first projections and will pass along the longitudinal slot to engage the groove to retain the key in the plug subsequent to rotation thereof. The second projection also cooperates with the drive pin of the auxiliary pin tumbler stack, upon rotation of the plug by 180 degrees, to prevent the driver pin from engaging the keyway in the plug, such engagement trapping the key and disabling the lock.

BRIEF DESCRIPTION OF THE DRAWINGS

The present invention may be readily understood, and its numerous objects and advantages will become apparent to those skilled in the art, by reference to the accompanying drawings wherein like reference numerals refer to like elements in the figures and wherein.

DESCRIPTION OF THE DISCLOSED EMBODIMENT

Figure 1:
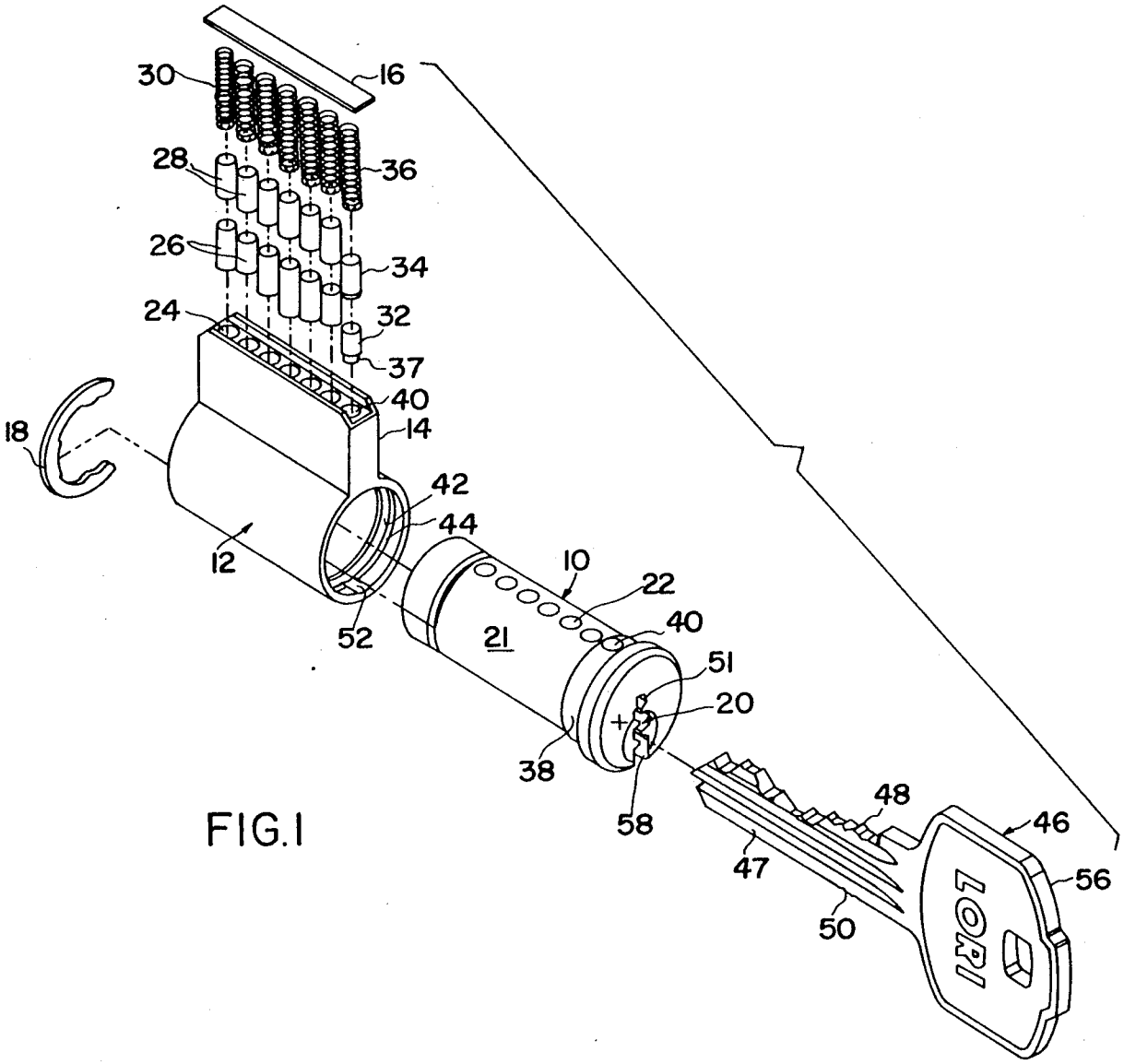
FIG. 1 is an exploded perspective view of a cylinder lock and key in accordance with the present invention.

With reference now to the drawings, a cylinder lock in accordance with the present invention includes a plug and a shell, respectively indicated generally at 10 and 12. The lock of the disclosed embodiment is of the type known in the art as a "bible" lock, i.e., the single row of pin tumbler stacks with their associated biasing springs are received in chambers provided in a generally rectangular projection 14 which extends from shell 12. The pin tumbler stacks and springs are retained in the "bible" 14 by means of a plate 16, the plate 16 being affixed to the bible 14 in any suitable manner. The plug 10 is captured in the shell 12 by means of a spring-loaded lock ring 18.

Continuing to discuss the disclosed embodiment of the lock, and it is to be understood that the above-described construction exemplifies that employed in conventional cylinder locks, the plug 10 is provided with a keyway, indicated generally at 20, and has a cylindrical intermediate portion 21 in which a spaced row of bores 22 are formed. The bores or pin chambers 22 extend inwardly to intersect the keyway. The "bottom" pins 26 of the primary pin tumbler stacks are received in chambers 22. With the lock in the locked condition, the individual chambers 22 of the linear array of pin chambers in plug 10 will each be aligned with a bore which defines a pin tumbler chamber 24 in bible 14. Chambers 24 receive the driver pins 28 of the primary pin tumbler stacks. In the disclosed embodiment each of the primary pin tumbler stacks comprises a "bottom" pin 26, a "top" or driver pin 28 and a biasing spring 30. When the lock is in the locked condition, and a proper key is not inserted in the keyway 20 in plug 10, the spring biased driver pins 28 are positioned such that they extend across the shear line between the plug and shell and rotation of the plug relative to the shell is thus prevented. As may be seen from FIG. 2, insertion of a proper key results in translation of the pin tumbler stacks to place the interface or shear line between the bottom and driver pins at the shear line between the plug and shell and rotation of the plug with the bottom pins is possible.

In accordance with the present invention, and also as taught in U.S. Pat. No. 4,823,575, the lock is provided with an auxiliary pin tumbler stack which comprises a bottom pin 32, a driver pin 34 and a biasing spring 36. The plug 10 is provided with a forwardly disposed cylindrical portion 38 of increased diameter relative to the cylindrical intermediate portion 21 in which the pin chambers 22 are formed. The chamber 40 which receives the bottom pin 32 of the auxiliary pin tumbler stack is formed in enlarged diameter portion 38 of the plug and, as with chambers 24, extends inwardly to intercept the keyway. The shell 12 is provided with a recess 42 which is complementary in size and shape to, and which thus receives, the enlarged diameter portion 38 of plug 10. Recess 42 extends inwardly from the forwardly facing end of shell 12 to a stop or guide shoulder. A circumferential groove 44 is provided intermediate the width of recess 42. Groove 44, as may be seen from FIG. 2, is defined by a front shoulder, which extends generally radially with respect to the axis of the cylindrical shell, and an angled rear surface.

As in the case of U.S. Pat. No. 4,823,575, the key 46 is provided with bitting and a pair of oppositely disposed projections which extend from the edges of blade 47. The bitting in the disclosed embodiment is in the form of a conventional sawtooth cut. In the case of the "bible" lock which has been depicted for purposes of explanation, the bitting is on a single edge of the key. The projections, which are best seen from joint consideration of FIGS. 1 and 2, are indicated at 48 and 50. While the projections 48 and 50 could have the same shape, for purposes of explanation they are shown as having different shapes. The projection 48 operates, i.e., cams, the auxiliary pin tumbler stack when the key is inserted in the plug keyway. Projection 48 is provided with angularly oriented cam surfaces on all four sides and may, again by way of example, have a truncated pyramidal shape as shown in FIG. 5 of U.S. Pat. No. 4,823,575. As may be seen from FIG. 1, the key blade 47 in the disclosed embodiment is provided with a longitudinally extending undercut, not shown, which results in one side of projection 48 extending outwardly from the base of the cut and then inwardly to its top surface. Keyway 20 is provided with an upper portion 51 shaped and sized to receive projection 48. When compared to a conventional lock, in order to accommodate projection 48, the keyway 20 is of extended height for a portion of its length which extends across the auxiliary pin tumbler receiving bore 40. As noted above, that portion of keyway 20 which is of extended height is also shaped as necessary to accommodate the projection 48.

In the conventional manner, the keyway 20 extends through the bottom of plug 10. The shell 12 is provided, extending inwardly from the forwardly facing edge thereof, with a recess 52 which receives the projection 50 on the key blade. Recess 52 is oriented transversely with respect to the front shoulder of groove 44 and terminates at a point located inwardly beyond the intersection of the recess with groove 44. The projection 50 is provided with an angled surface on the side which faces the blade tip and with cam surfaces on the two sides which face in the opposite directions of key rotation. The shape of the angled side of projection 50 which faces the blade tip is complementary to the angled rearwardly disposed side of groove 44. Since projection 50 functions to retain the key in the keyway when the plug has been rotated from the locked position, in the disclosed embodiment projection 50 is provided with a flat surface 54 on the side which faces the bow 56 of the key. This flat surface 54, which need not be provided on projection 48 since projection 48 does not extend into groove 44, cooperates with the front radially extending shoulder which in-part defines the groove 44. This cooperation results from the fact that projection 50 on the key blade is of greater height than projection 48. Restated, projection 50 is longer than the width, in the radial direction, of increased diameter portion 38 of plug 10 and projection 50 thus extends outwardly from the plug into the groove 44 in the shell. It is also to be noted that the lower portion 58 of the keyway, which accepts projection 50, may be of increased width when compared to the portion of the keyway which accepts the remainder of blade 47.

Figure 2:
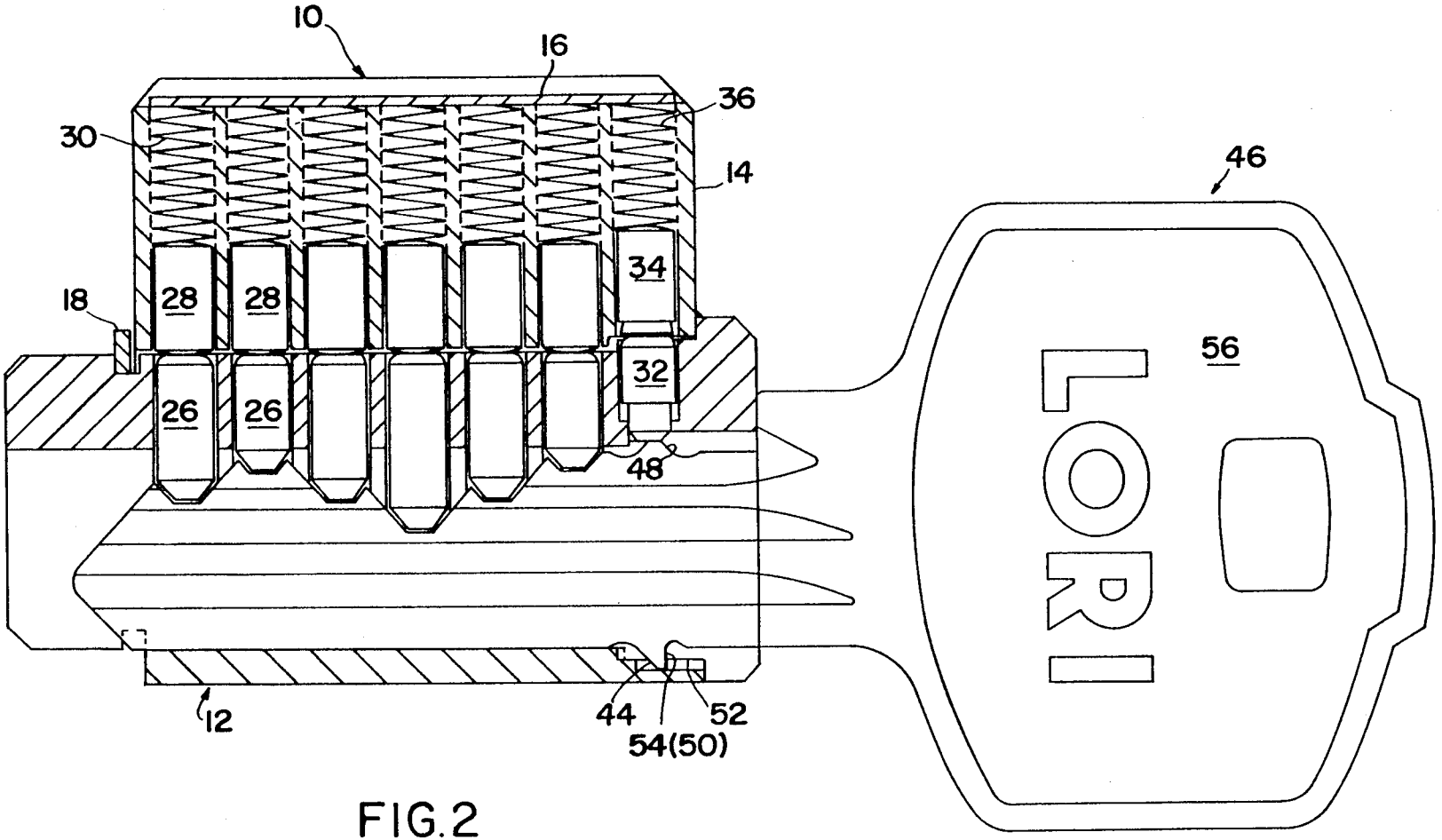
FIG. 2 is a cross-sectional, side elevational view of the combination of FIG. 1, the key not being shown in cross-section in FIG. 2 in the interest of facilitating understanding of the invention.

To describe operation of the key and lock combination of the present invention, upon insertion of the key 46 in the keyway 20, all of the pin tumbler stacks, including the auxiliary pin tumbler stack, will be translated to the positions shown in FIG. 2 where the shear lines between the driver and bottom pins register with the shear line between the plug and shell. This unlocks the lock and permits rotation of the plug relative to the shell. During such rotation the forward facing surface on projection 50 on the key blade cooperates with the front shoulder of groove 44 to retain the key in the lock. When the plug has been rotated 180 degrees, the projection 50 will contact the auxiliary driver pin 34 and will keep this pin in the raised position where it is shown in FIG. 2. If projection 50 were not present, when the plug was rotated by 180 degrees the lower end 37 of driver pin 34 would be forced by biasing spring 36 into the portion 58 of keyway 20 which extends through enlarged diameter portion 38 of the plug and any further rotation of the key, in either direction, would be prevented. Also, since the bottom pin tumblers could not move outwardly, the key would be trapped.

To summarize, a key and lock combination in accordance with the present invention is characterized by two different parting or shear lines between the plug and shell which are operative at the same time and by the same key, i.e., the normal parting line defined by the shear lines of the primary pin tumbler stacks with a proper key inserted and a second parting line defined by the recess 42 in shell 12 and enlarged diameter portion 38 of the plug. Additionally, the present invention is characterized by a key which, in addition to the primary bitting, is provided with a pair of aligned, oppositely disposed projections. One of these projections operates the auxiliary pin tumbler stack upon key insertion to position the shear line between the driver and bottom pins of the auxiliary pin tumbler stack at the above-mentioned second parting line. The second of these projections, i.e., the key retention projection, upon 180 degree rotation of the plug, prevents the driver pin of the auxiliary pin tumbler stack from moving inwardly so as to cross the second parting line. The aligned projections 48 and 50 on the key are both provided with camming surfaces which cooperate respectively with the bottom and driver pins of the auxiliary pin tumbler stack but those projections otherwise need not be the same shape. The key projection 50 which functions to retain the key in the keyway will be longer, i.e., will extend outwardly from the edge of the blade a greater distance, when compared to projection 48 in order to achieve the key retention function. It is, in fact, to be noted that projection 48 may actually extend forwardly to the bow since this projection does not engage groove 44.

While a preferred embodiment has been shown for purposes of illustration, various modifications may be made thereto without departing form the spirit and scope of the invention. Accordingly, the present invention has been described by way of illustration and not limitations.

What is claimed is:

1. A lock system comprising:

a key comprising a bow portion and a blade which longitudinally extends from said bow portion to a tip, said blade having a pair of spaced parallel edges which are interconnected by opposed side faces, said blade being provided with surface irregularities which define the key bitting, a shaped camming projection transversely extending from each of said edges, said projections being at least in part in alignment, a second of said projections extending outwardly from the edge of the key a greater distance when compared to the oppositely disposed first projection;

shell means including a shell having a longitudinal axis, said shell including a first cylindrical portion having a first diameter, at least a first row of primary pin tumbler means receiving chambers being located in said first portion, said shell having a second cylindrical portion which is also coaxial with said first portion, said second portion having a second diameter which is greater than said first diameter, an auxiliary pin tumbler means receiving chamber being provided in said second portion, said shell further having a circumferential groove intermediate the ends of said second portion, said auxiliary pin tumbler means receiving chamber intercepting said groove;

plug means rotatably mounted in said shell means, said plug means having a face and further having a longitudinally extending keyway formed therein, said keyway having a first portion in registration with said shell first portion and a second portion in registration with said shell second portion, said keyway second portion opening through said face and extending into registration with said shell second portion, said plug means also having first and second cylindrical portions of different diameter which are generally complementary to and received in said shell first and second portions, said plug means defining at least a first row of primary pin tumbler means receiving chambers in said first portion thereof, said first row of primary pin tumbler means receiving chambers being alignable with said shell primary pin tumbler means receiving chambers, said plug means defining an auxiliary pin tumbler means receiving chamber in the said second portion thereof, said auxiliary pin tumbler means receiving chamber being alignable with said shell auxiliary pin tumbler means receiving chamber, first and second shear lines respectively being defined between said shell means and said plug means first and second portions; and pin tumbler means reciprocally mounted in said receiving chambers, said pin tumbler means each including at least a bottom pin and a driver pin, said pin tumbler means including biasing means for urging a pin of each of said pin tumbler means to a position of bridging a shear line when a key is not present in said keyway, insertion of a properly bitted key into the keyway displacing said pin tumbler means against associated biasing means whereby the interface between the bottom and driver pins is located on a shear line, the displacement of the pin tumbler means positioned in said auxiliary pin tumbler means receiving chambers being caused by contact with a first of said key edge camming projections, rotation of said plug means relative to said shell means being permitted by said pin tumbler means displacement, the other of said key blade edge projections travelling in said shell means groove during such relative rotation, withdrawal of said key subsequent to said relative rotation being prevented by interference between said second projection and a side wall of said shell means groove.

2. The apparatus of claim 1 wherein said shell means groove first side extends generally radially with respect to the axis of said shell means second portion.

3. The apparatus of claim 2 wherein said key blade first projection is provided with camming surfaces on at least three sides thereof and wherein said key blade second projection is provided with camming surfaces on at least the two oppositely disposed side surfaces thereof and wherein the surface of said second projection which faces the bow portion of the said key extends in a direction which is generally transverse to the edge of the key blade.

4. A key for a cylinder lock comprising:

a bow;

a blade longitudinally extending from said bow and comprising a pair of longitudinally extending oppositely disposed and spaced edges, said blade further comprising side faces which connect said edges, said edges being at least in part substantially parallel to one another; and a projection extending outwardly from each of said oppositely disposed edges, said projections being at least in part in alignment, said projections each being shaped to define a plurality of cam surfaces, one of said projections extending outwardly from the adjoining edge by a greater distance when compared to the other of said projections.

5. The key of claim 4 wherein said projections each define cam surfaces which face in the two directions of possible key rotation when in use, and wherein the other of said projections additionally defines a cam surface which faces away from said bow.

6. The key of claim 4 wherein the projections decrease in cross-sectional size as they extend outwardly from the blade and wherein the said one of said projections has a sloped surface which faces the tip of the blade, the surface of said one projection which is oppositely disposed with respect to said sloped surface extending transversely with respect to the adjoining blade edge.

7. The key of claim 6 wherein said projections each define cam surfaces which face in the two directions of possible key rotation when in use, and wherein the other of said projections additionally defines a cam surface which faces away from said bow.

* * * * *